US006017671A

United States Patent [19]

Sacripante et al.

[11] Patent Number: 6,017,671

[45] Date of Patent: Jan. 25, 2000

[54] TONER AND DEVELOPER COMPOSITIONS

[75] Inventors: Guerino G. Sacripante, Oakville; Marko D. Saban, Etobicoke; Alan E. J. Toth, Burlington, all of Canada; Michael L. Grande, Palmyra; J. Stephen Kittelberger, Rochester, both of N.Y.

[73] Assignee: Xerox Corporation, Stamford, Conn.

[21] Appl. No.: 09/317,401

[22] Filed: May 24, 1999

[51] Int. Cl.[7] ..... G03G 9/087; G03G 9/097

[52] U.S. Cl. ..... 430/110; 430/109

[58] Field of Search ..... 430/109, 110

[56] References Cited

U.S. PATENT DOCUMENTS

| | | | |
|---|---|---|---|
| 3,590,000 | 6/1971 | Palermiti et al. | 430/110 |
| 4,049,447 | 9/1977 | Azar et al. | 430/109 |
| 4,052,325 | 10/1977 | Santilli | 430/115 |
| 4,513,074 | 4/1985 | Nash et al. | 430/106.6 |
| 4,525,445 | 6/1985 | De Roo et al. | 430/109 |
| 4,533,614 | 8/1985 | Fukumoto et al. | 430/99 |
| 4,543,313 | 9/1985 | Mahabadi et al. | 430/109 |
| 4,656,112 | 4/1987 | Kawagishi et al. | 430/110 |
| 4,845,003 | 7/1989 | Kiriu et al. | 430/110 |
| 4,891,293 | 1/1990 | Sacripante et al. | 430/109 |
| 4,940,644 | 7/1990 | Matsubara et al. | 430/109 |
| 4,957,774 | 9/1990 | Doi et al. | 427/45.1 |
| 4,968,575 | 11/1990 | Matsumura et al. | 430/110 |
| 5,004,664 | 4/1991 | Fuller et al. | 430/106.6 |
| 5,047,305 | 9/1991 | Uchida et al. | 430/110 |
| 5,057,392 | 10/1991 | McCabe et al. | 430/109 |
| 5,168,028 | 12/1992 | Nanya et al. | 430/110 |
| 5,324,613 | 6/1994 | Ciccarelli et al. | 430/110 |
| 5,348,832 | 9/1994 | Sacripante et al. | 430/109 |
| 5,466,554 | 11/1995 | Sacripante et al. | 430/110 |
| 5,560,965 | 10/1996 | Fukui et al. | 428/24 |
| 5,593,807 | 1/1997 | Sacripante et al. | 430/137 |
| 5,604,076 | 2/1997 | Patel et al. | 430/137 |
| 5,648,193 | 7/1997 | Patel et al. | 430/137 |
| 5,658,704 | 8/1997 | Patel et al. | 430/137 |
| 5,684,063 | 11/1997 | Patel et al. | 523/161 |
| 5,698,223 | 12/1997 | Mychajlowskij et al. | 430/137 |
| 5,698,422 | 12/1997 | Sacripante et al. | 430/109 |
| 5,866,290 | 2/1999 | Sacripante et al. | 430/109 |

*Primary Examiner*—Roland Martin
*Attorney, Agent, or Firm*—E. O. Palazzo

[57] ABSTRACT

A toner composition comprised of a polyester resin with hydrophobic end groups, colorant, optional wax, optional charge additive, and optional surface additives.

74 Claims, No Drawings

TONER AND DEVELOPER COMPOSITIONS

BACKGROUND OF THE INVENTION

The present invention is generally directed to toner and developer compositions, and more specifically, the present invention is directed to a developer composition comprised of carrier, and toner containing a polyester with both hydrophilic and hydrophobic groups and wherein the main chain of the resin contains a hydrophilic moiety, that is, for example, wherein moiety refers to a group or groups on the main polymer chain in an amount of, for example, from about 0.5 to about 3 percent based on the amount of toner polyester polymer, or parts which, for example, impart or assist in imparting excellent triboelectrical and with rapid admix characteristics, and wherein the end groups of the polyester resin are modified with or contain hydrophobic moieties, groups, or segments, preferably two, present in an amount of, for example, from about 0.5 to about 2 percent or parts based on the amount of polyester polymer to, for example, impart or assist in imparting excellent relative humidity sensitivity to the toner. In embodiments, there are provided in accordance with the present invention toner compositions comprised of colorant particles, and resin particles comprised of a polyester resin containing hydrophilic moieties such as a sodio sulfonate group or groups, in an amount for the moieties, groups, or segments of, for example, from about 0.5 to about 3 weight percent of the polyester resin or polymer and preferably from about 1 to about 2 weight percent of the resin, and hydrophobic, that is for example nonpolar, or nonwater liking groups such as alkyl, alkylene, with, for example, from 6 to about 120 carbon atoms, such as hexyl, lauryl, stearyl, cetyl, polyethylene, polypropylene and the like. More specifically, in embodiments of the present invention, there is provided a toner comprised of colorant, especially pigment particles, optionally a charge enhancing agent, optionally a wax component, and a polyester resin containing both a hydrophilic moiety on the main chain, and hydrophobic end groups, and which polyester is illustrated by Formulas I through III

I

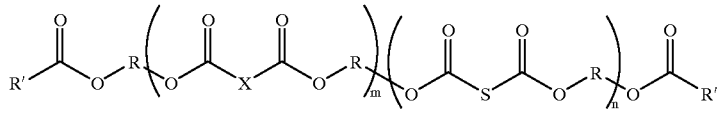

II

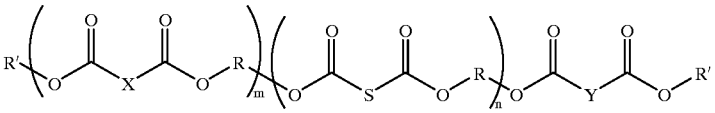

III

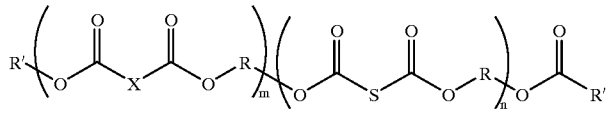

wherein R is an alkylene group, such as a divalent ethylene, propylene, butylene, ethyleneoxyethylene or generally a hydrocarbon, with from about 2 to about 24 carbon atoms, from about 2 to about 22, and preferably from about 2 to about 20 carbon atoms, and more specifically, with 1, 2, 3, 4, 5, 6, 7, 8, 9, 10, 11, 12, 13, 14, 15, 16, 17, 18, 19, 20, 21, or 22 carbon atoms; a cycloalkylene like cyclohexylene or a 1,4-dimethyl cyclohexylene group; X is an aromatic, such as an arylene group, with, for example, from about 6 to about 14 carbon atoms, such as the moieties of phenylene, isophthalylene, terephthalylene or phthalylene, an olefinic group (or groups throughout), such as vinylene, methylvinylene, or an alkylene group such as ethylene, propylene, butylene, pentylene, hexylene, and the like; R' is a hydrophobic group or groups, such as an alkyl group with, for example, from about 2 to about 120 carbon atoms, such as hexyl, heptyl, octyl, lauryl, stearyl, alkylene, such as polyethylene or polypropylene; and m and n represents the number of random segments, such as a number of from about 10 to about 100 for n and about 20 to about 2,000 for m or 20 times n; S is a hydrophilic group, such as an alkali earth metal salt of an arylenesulfonate or alkylenesulfonate, and more specifically, an alkaline earth metal such as lithium, sodium, potassium, cesium, berylium, magnesium, calcium or barium, an arylenesulfonate such as phenylenesulfonate, isophthalylene-5-sulfonate, terephthalylene-sulfonate or phthalylenesulfonate, or an alkylenesulfonate such as propylenesulfonate, butylenesulfonate, pentylenesulfonate, hexylenesulfonate; and Y can be either X or S. The polyester resin can be branched or crosslinked by employing trifunctional or multifunctional reagents, such as trimethylolpropane or pyromellitic acid, in an amount of, for example, from about 0.1 to about 6 mole percent based on the starting diacid or diester selected to prepare the polyester resin, and which branching agent can be represented in the above Formulas I through III by incorporating the branching segments, p, q, r or s as illustrated by the formulas

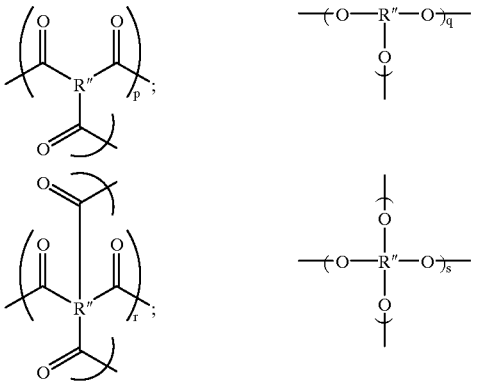

wherein R" is a multivalent aromatic radical with, for example, from about 6 to about 30 carbon atoms, or an aliphatic radical with from about 3 to about 20 carbon atoms, such as the tri or tetravalent derivatives of propane, butane, pentane, hexane, cyclohexane, heptane, octane, benzene, naphthalene, anthracene, and the like; and p, q, r and s represent the branching segment and in embodiments each is from about 0.1 to about 6 mole percent based on the starting diacid or diester used to generate the resin and provided that the sum of segments p and q, or r and s is 100 mole percent of the polyester resin.

In embodiments, the present invention relates to the preparation of a polyester resin, and wherein the hydroxyl and acid end groups of the resulting polyester are minimized, and preferably avoided. Polyester resins are known to contain acid and hydroxyl groups of from about 20 to about 1,000 milliequivalents per gram of polyester, usually present as end groups. It is believed that these hydrophilic end groups may cause the toner composites to possess tribocharging performance that is humidity sensitive, wherein the ratio of the triboelectric charge of the toner composites at low humidity to that at high humidity is of from about 2.8 to about 4.5, and usually from about 3.0 to about 3.5. To reduce the relative humidity sensitivity of polyester based toners, the present invention minimizes the hydrophilic end groups, such as hydroxyl or acid moieties on the polyester resin, by capping the ends of the polyester with hydrophobic groups, such as alkyl moieties, hence resulting in toners with low humidity sensitivity in embodiments such as from about 1.0 to about 2.8 and preferably from about 1.0 to about 2.5.

Another embodiment of the present invention relates to the obtaining toner composition with excellent triboelectrical stability and rapid admix such as less than about 1 minute and preferable less than about 30 seconds, for example from about 5 to about 15 seconds, and which toner contains a polyester resin with a hydrophilic moiety, such as a sodio sulfonate group, present on the main chain of the resin. A further embodiment of the present invention relates to the preparation of a polyester resin with monofunctional monomers that cap the ends of the polyester resin to result in the aforementioned polyester resin with hydrophobic end groups, and wherein the concentration of the monofunctional hydrophobic monomers is from about 0.1 mole percent to about 4 mole percent based on the starting diacid or diester used to generate the resin, and thereby controls the weight average molecular weight of from about 4,000 grams per mole to about 250,000 grams per mole, especially when monofunctional monomers with a carbon chain length of from about 4 to about 24 are selected or wherein the use of bulkier monomers such as 1,2-naphthalene ethanol, or phenylmethanol are utilized; and wherein a hydrophilic moiety such as sodio sulfonate group is present in the main chain of the polyester resin, and wherein the concentration of the hydrophilic moiety is from about 0.1 to about 5 weight percent of the resin, and preferably of from about 0.5 to about 2.5 weight percent of the resin.

The aforementioned toner composition and developer thereof, that is toner mixed with a carrier, display a low relative humidity sensitivity for the toners in embodiments of the present invention, which is desired since the triboelectric charge remains stable with changes in environmental humidity conditions. Additionally, the toners possess rapid admix characteristics, such as less than about 60 seconds, and preferably less than 30 seconds, for example from about 5 to about 15 seconds, and low minimum fixing temperatures, such as from about 130° C. to about 145° C., with broad fusing latitudes, such as from about 30° C. to about 90° C. Copiers and printers equipped with two component developers, that is a toner as one component mixed with the carrier as the other component, can exhibit a positive or negative triboelectric charge with a magnitude of from about 5 microcoulombs per gram to about 40 microcoulombs per grams. This triboelectric charge permits the toner particles to be transferred to the latent image of the photoreceptor with an opposite charge, thereby forming a toned image on the photoreceptor, which is subsequently transferred to a paper or a transparency substrate, and thereafter subjected to fusing or fixing processes. In these development systems, it is important for the triboelectric charge to be stable under differing environmental humidity conditions such that the triboelectric charge does not change substantially by more than from about 5 to about 10 microcoulombs per gram. A change of more than from about 5 microcoulombs per gram to about 10 microcoulombs per gram in the triboelectric charge of the toner developer can cause nonuniform toned images or result in no toning of the photoreceptor, thus unbalanced density or gray scale is observed in the developed images, or no developed images at all result. Generally, humidity ranges may differ from less than about 20 percent in dry regions to more than about 80 percent in humid regions, and some geographical regions may exhibit fluctuations of up to from about 50 to about 90 percent humidity level within the same day. In such climates, it is important that the developmental triboelectric charge does not change by more than from about 5 microcoulombs per gram to about 10 microcoulombs per gram. As toner resins generally represent from about 80 percent to about 98 percent by weight of toner, the resin sensitivity to moisture or humidity conditions should be minimized thereby not adversely affecting the triboelectric charge thereof. Furthermore, the toners should preferably possess rapid admix characteristics, such that when copiers and printers are replenished with fresh toners, the developers can re-establish the necessary triboelectric charge within less than 1 minute, and preferably less than 30 seconds.

A number of toner polymeric resins utilized as toner compositions, such as for example styrene-acrylates, styrene-methacrylates, styrene-butadienes and especially polyesters, contain from about 0.1 to about 2 percent by weight of moisture, and in some instances, the moisture content of polyesters may change from about 0.1 to about 4 percent by weight at humidity levels ranging from about 10 to about 100 percent, or more usually from about 20 percent to about 80 percent humidity. These changes in moisture content of the resin may have a dramatic adverse effect on the triboelectric charge of the toner and developer thereof.

Relative humidity sensitivity of toner is customarily measured by first fabricating a toner comprised of a pigment, optional charge control agent and a resin, then admixing the toner from about 3 percent by weight to about 7 percent by weight with a carrier. The developer composition is then equilibrated to various humidity levels in a sealed chamber at controlled temperatures of 60° F. at 20 percent RH and 80° C. at 80° F. for a period of about 48 hours. The triboelectric charge is then measured for the same developer composition at different humidity levels and the results analyzed by several methods, such as graphing the triboelectric charge as a function of humidity level and observing the regions in which dramatic changes occur. Another measuring method comprises dividing the aforementioned graphical interpolation of tribo versus humidity level in three regions, wherein region A is from about 0 to about 30 percent humidity, region B is from about 30 to about 65 percent humidity, and region C is higher than about 65 percent humidity to about 100 percent. Since these measurements are cumbersome and time consuming, there can be measured the triboelectric charge after subjecting the toner developer composition to two humidity levels, such as 20 percent relative humidity and 80 percent relative humidity, and then calculating the relative sensitivity by the triboelectric charge ratio of the 20 to 80 percent relative humidity as follows Equation 1

$$\text{Relative Humidity Sensitivity} = \frac{\text{Triboelectric Charge at 20\% RH at 60° F.}}{\text{Triboelectric Charge at 80\% RH at 80° F.}}$$

wherein RH is the relative humidity.

Thus, if the relative humidity sensitivity is about 1, the toner composition is considered humidity insensitive, whereas if the humidity sensitivity is greater than about 3, the toner composition is considered to be humidity sensitive. It is generally believed that toners prepared with a number of polymeric materials exhibit relative sensitivity greater than 1.0, and in general, styrene butadiene, or styrene acrylate based toners possess humidity sensitivities greater than 1.0 and less than about 2.5, whereas generally, polyester based toners possess a relative humidity sensitivity of greater than 2.5 and less than about 5. Hence, an advantage of the styrene-acrylate or styrene-butadiene type binder resins for toners over that of polyesters is their lower relative humidity sensitivity. Polyesters are known to display advantages over styrene based resins, such as low fixing temperatures of from about 120° C. to about 140° C., and nonvinyl offset properties. Therefore, there is a need for toner compositions comprised of a resin which possess many of the aforementioned advantages, such as low fixing temperature of from about 120° C. to about 140° C., nonvinyl offset properties, and in addition low sensitivity of tribocharging as a function of relative humidity such that the ratio of triboelectric charge at 20 percent and 80 percent RH is from about 1.0 to about 2.5. These and other advantages are attained in embodiments with the toner compositions of the present invention comprised of a pigment, optionally a charge control agent, and a modified polyester resin wherein the end groups are hydrophobic moieties, and which toner exhibits a low fixing temperature of from about 120° C. to about 140° C., nonvinyl offset properties, and low relative humidity sensitivity, such as from about 1.0 to about 2.5.

Furthermore, the presence of the hydrophobic end groups provide an improved process for obtaining polyesters. Specifically, the concentration of the monofunctional monomer and groups provides for the molecular weight control of the polyester product, and its reproducibility. The process for the preparation of the polyester resins of the present invention is referred to as a condensation process or step polymerization. The condensation process involves the addition of bifunctional monomers which result in dimers, followed by the reaction of dimers with dimers to form tetramers, or dimers with monomers to form trimers. The reaction sequence then continues in that these dimers, trimers and tetramers react with each other to form multiples thereof, known in the art as oligomers, which in turn react with other oligomers to form the polyester. In this kinetic scheme, the degree of polymerization is achieved by terminating the reaction at the desired point, hence it is time dependent. It is known that obtaining a specific degree of polymerization by relying on the time of the polymerization of the step reaction polymerization process is very difficult. A method for controlling the degree of polymerization is to adjust the composition of the reaction mixture away from stoichiometric equivalence, by adding a nonvolatile monofunctional reagent in an amount from about 0.1 mole percent to about 4 mole percent based on the starting diacid or diester used to make the resin. In the present invention, the monofunctional monomers employed are, for example, hydrophobic monomers. The degree of polymerization can further be controlled by the amount of monofunctional monomer utilized, hence limiting the degree of polymerization as determined by its concentration such that the total amount of end groups is proportional to the amount of monofunctional monomer employed. This aids in the reproducibility of the product by adjusting the amount of monofunctional monomer to the desired limit of degree of polymerization, hence avoiding total dependence on time of polymerization.

Additionally, the toner resin of the present invention contains a hydrophilic moiety, such as an alkali salt of a sulfonate group, which group is believed to impart triboelectric stability for long duration, such as from about 250,000 to about 1,000,000 prints or copies, and which function also enables rapid admix times such as less than about 1 minute and preferable less than about 30 seconds.

The toner compositions of the present invention in embodiments thereof possess excellent admix characteristics as indicated herein, and maintain their triboelectric charging characteristics for an extended number of imaging cycles up to, for example, 1,000,000 in a number of embodiments.

There is a need for toners with low relative humidity sensitivity, such as from about 1 to about 2.8 and preferably from about 1 to about 2.5 as calculated by Equation 1, and wherein excellent triboelectric stability is achieved, such as from about 250,000 to 1,000,000 prints or copies, as rapid admix time, such as from less than about 1 minute and preferably less than about 30 seconds, and wherein low minimum fixing temperatures are obtained, such as from about 120° C. to about 140° C. with broad fusing latitude such as from about 30° C. to about 45° C., wherein the fusing latitude is considered the difference between the minimum fixing temperature and the temperature at which the toner offsets to the fusing member. These and other needs can be achievable with the present invention in embodiments thereof.

PRIOR ART

Certain polyester toner resins are known, reference for example U.S. Pat. Nos. 3,590,000 and 4,525,445, which illustrate a linear polyester comprised preferably of propoxylated bisphenol A and fumaric acid, and available as SPAR II® from a number of sources such as Atlas Chemical Company. There is also disclosed in Japanese Laid Open Patents. Further, there is disclosed in U.S. Pat. No. 4,533,614, and more specifically, U.S. Pat. Nos. 4,957,774 and 4,533,614 linear polyester resins comprised of dodecylsuccinic anhydride, terephthalic acid, alkyloxylated bisphenol A and trimellitic anhydride as chain extenders.

Additionally, there is disclosed in U.S. Pat. No. 4,940,644, U.S. Pat. No. 5,047,305, U.S. Pat. No. 4,049,447, and Canadian Patent 1,032,804 a linear polyester comprised of an amorphous aromatic polyester derived from an arylene radical and diol, and specifically resins such as poly (neopentylterephthalate) comprised of terephthalate radical and neopentyl glycol. Also, there is disclosed in U.S. Pat. No. 4,525,445 a toner composition comprised of a linear polyester derived from fumaric acid, isophthalic acid and propoxylated bisphenol. Further, other toner compositions are known to contain linear polyester resins, such as those disclosed in U.S. Pat. No. 4,968,575 a linear polyester blocked with rosin compound; U.S. Pat. No. 5,004,664 a linear polyester prepared from the ring opening polymerization of cyclic monomers; U.S. Pat. No. 5,057,392 a blend of resins comprised of a crystalline and amorphous polyesters; and U.S. Pat. Nos. 4,543,313 and 4,891,293 wherein there are disclosed linear thermotropic liquid crystalline polyester resins, the disclosures of which are totally incorporated herein by reference. Other U.S. Patents of interest disclosing, for example, linear polyesters are U.S. Pat. Nos. 4,052,325; 3,998,747; 3,909,482; 4,4049,447; 4,288,516; 4,140,644; 4,489,150; 4,478,423; 4,451,837; 4,446,302; 4,416,965; 4,866,158; 5,153,301; 5,116,713; 5,043,242; 5,045,424; 5,049;646; 5,102,762; 5,110,977 and 4,837,394.

Compositions containing modified polyester resins with a polybasic carboxylic acid are also known and disclosed in Japanese Laid Open Nos. 44836 (1975); 3753 (1982) and 109875 (1982); and also in U.S. Pat. No. 3,681,106, and more specifically branched or crosslinked polyesters derived from polyvalent acids or alcohols are illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539. In some of the aforementioned prior art references, there are disclosed polyester resins wherein the end groups are either an acid group, wherein acid numbers are reported, and/or wherein hydroxyl groups are present.

Polyester based resins comprised of hydrophilic moieties such as alkali sulfonate groups are known, and disclosed in U.S. Pat. Nos. 5,348,832; 5,593,807; 5,604,076; 5,648,193; 5,658,704; 5,660,965; 5,684,063; and 5,698,223, the disclosure of which is totally incorporated herein by reference. The aforementioned prior art polyester resins contain hydrophilic moieties, preferably in an amount range of from about 2 to about 7.5 percent by weight of resin, and utilized such that dissipation, or emulsification of the resin in water is obtained.

To prevent fuser roll offsetting and to increase the fuser latitude of toners, various modifications to toner compositions have been proposed. For example, U.S. Pat. No. 4,513,074 discloses adding waxes, such as low molecular weight polyethylene, polypropylene, to toners to increase their release properties. To sufficiently prevent offset, however, considerable amounts of such materials may be required, resulting in the detrimental effect of toner agglomeration, degradation in free flow properties, and destabilization of charging properties.

There is illustrated in U.S. Pat. No. 5,168,028 a negatively chargeable toner for developing latent electrostatic images comprising a binder resin, a coloring agent and a charge controlling agent which comprises a fluorine-containing quaternary ammonium salt. There are illustrated in U.S. Pat. No. 5,324,613 toners with hydroxy bis(3,5-ditertiary butyl salicylic) aluminate monohydrate; U.S. Pat. No. 4,656,112 toners with a zinc complex (E-84) of 3,5-ditertiary butyl salicylate; and U.S. Pat. No. 4,845,003 toners with a hydroxy carboxylic acid. The disclosures of each of the aforementioned patents are totally incorporated herein by reference.

SUMMARY OF THE INVENTION

It is a feature of the present invention to provide toner and developer compositions wherein the polyester toner binder resin contains hydrophilic groups and hydrophobic end groups.

In another feature of the present invention there are provided negatively charged toner compositions useful for the development of electrostatic latent images including color images.

In yet another feature of the present invention there are provided negatively charged toner or positively charged toner compositions containing polyester with hydrophobic end groups such as a hydrocarbon or aromatic moiety of from about 4 carbon atoms to about 120 carbon atoms.

Moreover, in another feature of the present invention there are provided negatively charged toner compositions containing polyester with hydrophilic moieties or group, such as an alkali salt of a sulfonate moiety such as sodio sulfonate, lithio sulfonate, potassium sulfonate, berylio sulfonate, masio sulfonate or bario sulfonate.

Also, in another feature of the present invention there are provided developer compositions with negatively charged toner particles, and carrier particles.

Additionally, in a further feature of the present invention there are provided toners having triboelectric properties with low humidity sensitivity such as, for example, from about 1.0 to about 2.5.

In yet a further feature of the present invention there are provided toners with triboelectric stability such as, for example, from about 250,000 to about 5,000,000 copies or prints in the Xerox Corporation 6180 printer, and toners with rapid admix time such as, for example, less than about 1 minute and preferably less than about 30 seconds, such as from about 5 to about 30 seconds.

Also, in another feature of the present invention there are provided toners having triboelectric properties with low humidity sensitivity, such as for example, from about 1.0 to about 2.5, with desirable admix properties of about 15 seconds to about 60 seconds as determined by the charge spectrograph, and preferably about 15 to about 30 seconds.

Moreover, in another feature of the present invention there are provided toners having triboelectric properties with low humidity sensitivity with low minimum fixing temperatures such as from about 120° C. to about 140° C.

In another feature of the present invention there are provided toners with suitable triboelectric properties, low humidity sensitivity, and broad fusing latitude, such as from about 30° C. to about 45° C.

In another feature of the present invention there is provided a method for reproducibly controlling the degree of polymerization.

Furthermore, in yet another feature of the present invention there are provided toner and developer compositions that are useful in a variety of electrostatic imaging and printing processes, including color xerography, and wherein the admix charging times are less than or equal to about 60 seconds.

These and other features of the present invention can be accomplished in embodiments thereof by providing toner compositions comprised of colorant, such as pigment particles, and a polyester resin wherein the end groups are hydrophobic.

Aspects of the present invention relate to a toner composition comprised of a polyester resin with hydrophilic moieties, or groups and hydrophobic end groups, colorant, optional wax, optional charge additive, and optional surface additives; a toner composition comprised of a polyester resin containing at least one hydrophilic group, at least one hydrophobic group, and colorant; a toner wherein the polyester resin is derived from at least one organic diol monomer, at least one organic diacid or diester monomer, and at least one hydrophobic monofunctional alcohol or monofunctional acid monomer, at least one alkali or alkaline earth metal salt of alkylene sulfonate, an arylene sulfonate diacid, or diester monomer; a toner composition containing a polyester resin of the formulas

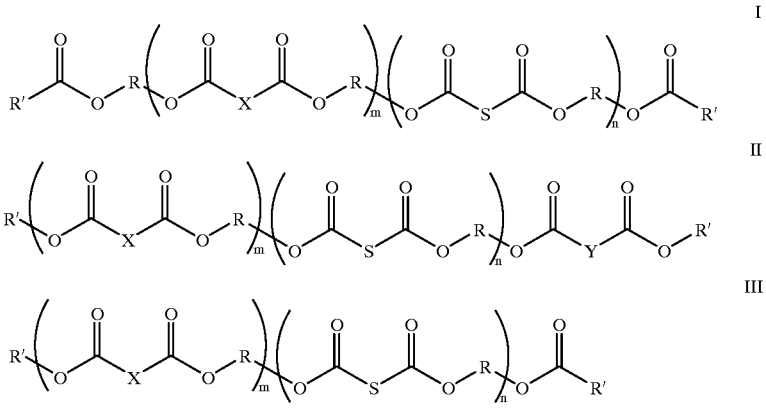

I

II

III wherein R is a hydrocarbon; X is arylene, an olefinic group or groups, or an alkylene; R' is alkyl or alkylene; and m and n represent the number of random segments; S is a hydrophilic group, Y is equivalent to X or S, a toner composition wherein R (for the polyester) is an alkylene; a toner composition wherein R is alkylene with from about 2 to about 20 carbon atoms; a toner composition wherein the hydrocarbon possesses from about 2 to about 22 carbon atoms; a toner composition wherein the polyester R is cyclohexylene; a toner composition wherein R is 1,4-dimethyl cyclohexylene; a toner composition wherein the polyester R is ethylene, propylene, butylene, or ethyleneoxyethylene; a toner composition wherein the X arylene possesses from about 6 to about 30 carbon atoms; a toner composition wherein the polyester X is phenylene; a toner composition wherein X is phthalylene; a toner composition wherein X is terephthalylene; a toner composition wherein X is isophthalylene; a toner composition wherein the X olefinic group possesses from about 2 to about 12 carbon atoms; a toner composition wherein the X olefinic group is vinylene; a toner composition wherein the X olefinic group is methylvinylene; a toner composition wherein the X alkylene possesses from about 2 to about 20 carbon atoms; a toner composition wherein the X alkylene is ethylene, propylene, butylene, pentylene or hexylene; a toner composition wherein R' alkyl contains from 1 to about 120 carbon atoms; a toner composition wherein the polyester R' alkyl contains from about 5 to about 30 carbon atoms; a toner composition wherein the R' alkyl is hexyl, heptyl, octyl, lauryl or stearyl; a toner composition wherein the R' alkylene is polyethylene or polypropylene; a toner composition wherein the polyester m is a number of from about 20 to about 2,000; a toner composition wherein the polyester m is a number of from about 50 to about 125; a toner composition wherein the polyester n is a number of from about 1 to about 100; a toner composition wherein the polyester n is a number of from about 50 to about 125; a toner composition wherein the polyester m is a number of from about 100 to about 500, n is a number of from about 15 to about 25, and wherein m is 20 times the value of n; a toner composition wherein the polyester S is an alkali earth metal salt of an arylene sulfonate; a toner composition wherein S is an alkali earth metal salt of an alkylene sulfonate; a toner composition wherein S is an alkaline earth metal salt of an arylene sulfonate, and wherein the metal is lithium, sodium, potassium, cesium, berylium, magnesium, calcium or barium; a toner composition wherein X is an alkali earth metal salt of phenylene sulfonate; a toner composition wherein S is an alkali metal salt of isophthalylene 5-sulfonate, terephthalylene sulfonate, or alkylene sulfonate; a toner composition wherein the polyester R' and X are methylene, propylene, ethylene, butylene, pentylene, hexylene, or heptylene; a toner composition wherein the polyester resin is further comprised of an additional branching segment, p or q, or mixtures thereof as illustrated by the formulas

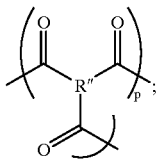

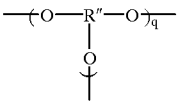

wherein R" is a trivalent aromatic or aliphatic radical with from about 3 to about 20 carbon atoms; and p and q represent the branching segment and are from about 0.1 to about 6 mole percent based on the starting diacid or diester used to prepare the resin, and wherein the sum of segments p and q is 100 mole percent of the polyester resin; a toner composition wherein R" is the trivalent derivatives of propane, butane, pentane, hexane, cyclohexane, heptane, octane, benzene, naphthalene, or anthracene; a toner composition wherein p and q each are from about 0.1 to about 6 mole percent based on the diacid or diester reactant selected for the preparation of the polyester; a toner composition wherein the polyester resin is further comprised of an additional branching segment, r or s, or mixtures thereof as illustrated by the formulas

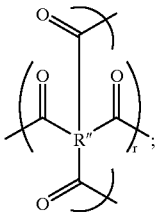

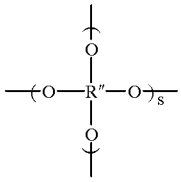

wherein R" is multifunctional radical, and wherein the sum of segments r and s are 100 mole percent of the polyester resin; a toner composition wherein R" is a polyvalent or tetravalent aromatic or aliphatic radical with from about 3 to about 20 carbon atoms for the aliphatic, and from about 6 to about 30 for the aromatic; and r and s represent the branching segment and are from about 0.1 to about 6 mole percent based on the starting diacid or diester; a toner composition wherein the polyester hydrophobic groups are end groups of poly(1,2-propylene terephthalate-co-diethylene terephthalate) end blocked with an alkyl group of stearyl or stearate, poly(1,2-propylene terephthalate-co-diethylene terephthalate-co-1,1,1-trimethylene propane terephthalate) end blocked with an alkyl group of stearyl or stearate, poly(1,2-propylene terephthalate) end blocked with an alkyl group such as stearyl or stearate, poly(1,2-propylene terephthalate-co-diethylene terephthalate) end blocked with alkyl group of lauryl or laurate, poly(1,2-propylene terephthalate-co-diethylene terephthalate) end blocked with an alkyl group of cetyl or palmitate, poly(1,2-propylene terephthalate-co-diethylene terephthalate) end blocked with octoate, poly(1,2-propyleneterephthalate-co-diethylene terephthalate) end blocked with an alkyl group of palmitate, stearyl, lauryl, palmitate, stearate, or laurate; and mixtures thereof; a toner composition wherein the polyester S is an ion salt of a sulfonated difunctional monomer wherein the ion is an alkali or alkaline earth of lithium, sodium, potassium, cesium, rubidium, magnesium, barium, calcium or berylium, and the sulfonated difunctional moiety or monene is selected from the group consisting of dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfopentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, and mixtures thereof; a toner composition wherein the polyester resin possesses a number average molecular weight of from about 2,000 grams per mole to about 100,000 grams per mole, a weight average molecular weight of from about 4,000 grams per mole to about 250,000 grams per mole, and a polydispersity of from about 1.8 to about 17; a toner composition with a triboelectric charge relative humidity sensitivity of from about 1.0 to about 2.8; a toner composition with a triboelectric charge relative humidity sensitivity of from about 1 to about 2.5; a toner composition wherein a charge enhancing additive is further included and is present in an amount of, for example, from about 0.05 to about 5 weight percent, and there results a positively or negatively charged toner; a toner composition wherein the charge enhancing additive is incorporated into the toner, or is present on the surface of the toner composition, and there results a positively or negatively charged toner; a toner composition further containing a wax component with a weight average molecular weight of, for example, from about 1,000 to about 20,000; a toner composition wherein the wax component is selected from the group consisting of polyethylene and polypropylene; a toner composition further containing as external additives metal salts of a fatty acid, colloidal silicas, metal oxides, or mixtures thereof; a toner composition wherein the colorant is carbon black, cyan, magenta, yellow, red, blue, green, brown, or mixtures thereof; a developer composition comprised of the polyester containing toner composition and carrier particles; a method of imaging which comprises formulating an electrostatic latent image on a negatively charged photoreceptor, affecting development thereof with the polyester containing toner composition illustrated herein, and thereafter transferring the developed image to a suitable substrate; a process for the preparation of a polyester resin with both at least one hydrophilic moiety and at least one hydrophobic end group, and preferably two end groups, which comprises the polyesterification of a diester or diacid with a diol or mixtures of diols, a polycondensation catalyst, a polyfunctional reagent, and a monofunctional hydrophobic end group monomer; a process wherein the diester or diacid is a malonic acid, succinic acid, 2-methylsuccinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein alkyl contains about 1 carbon atom to about 5 carbon atoms and are diesters of malonic acid, succinic acid, 2-methyl succinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, mixtures thereof; and which diester, or diacid is optionally selected in effective amounts of from about 45 to about 55 mole percent of the polyester resin; wherein the diol or glycol is diethylene glycol, ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, or mixtures thereof; and which glycol is optionally selected in effective amounts of from about 45 to about 55 mole percent of the polyester resin; wherein there is selected for the reaction a polycondensation catalyst of tetraalkyl titanates, dialkyltin oxide, tetraalkyl tin, alkyltin oxide hydroxide, aluminum alkoxides, alkyl zinc, dialkyl zinc, zinc oxide, stannous oxide, or mixtures thereof, and which catalysts are optionally selected in effective amounts of from about 0.01 mole percent to about 5 mole percent based on the starting diacid or diester used to prepare the resin, and wherein the monofunctional hydrophobic end group monomer is hexanol, heptanol, octanol, nonanol, decanol, undecanol, dodecanol, tridecanol, tetradecanol, pentadecanol, hexadecanol, heptadecanol, octadecanol, and other alcohols derived from about 6 to about 24 carbon atoms, oleyl alcohol, linoleyl alcohol, cinnamyl alcohol, alkyl substituted alcohols 2-methylhexanol, 2,3,3-trimethylhexanol, 2-methyloctanol and 3,7-dimethyl-1,6-octadien-3-ol, and benzyl alcohol; monofunctional acids butyric acid, hexanoic acid, heptanoic acid, octanoic acid, nonanoic acid, decanoic acid, stearic acid, lauric acid, palmitic acid, oleic acid, linoleic acid, cinnamic acid, higher alkyl acids derived from about 4 to about 24 carbon atoms, benzoic acid, naphthoic acid, or mixtures thereof; and which group is optionally present in effective amounts of from about 0.1 mole percent to about 4 mole percent based on the starting diacid or diester used to prepare the resin; a process wherein the polycondensation is accomplished at a temperature of from about 165° C. to about 190° C. for a duration of from about 360 minutes to about 8 hours, followed by increasing the temperature to from about 180° C. to about 220° C. and reducing the pressure from atmospheric to from about 0.1 millibar to about 100 millibars for a duration of from about 60 minutes to about 720 minutes, followed by discharging the polyester product and cooling to ambient temperature; a toner composition further containing a charge enhancing additive of a quaternary ammonium compound; a toner composition further containing a charge additive of hydroxy bis(3,5-ditertiary butyl salicylic) aluminate monohydrate, 3,5-ditertiary butyl salicylate, an aluminum compound of a hydroxy carboxylic acid, cetyl pyridinium halide, or distearyl dimethyl ammonium methyl sulfate, wherein the surface additives are comprised of metal salts of a fatty acid, colloidal silicas, metal oxides, or mixtures thereof, and wherein each surface additive is present in an amount of from about 0.1 to about 5 weight percent; a toner wherein the moiety or group is present on the main chain of the polymer, or is present as a pendant group; a toner composition wherein the polyester is generated from at least one multifunctional branching monomer; a toner comprised of a polyester resin containing at least one hydrophilic segment, hydrophobic segments, and colorant; a toner further containing a wax; a toner further containing surface additives; a toner wherein the surface additives are comprised of silica, metal oxides, metal salts of fatty acids, or mixtures thereof; a toner wherein each of the surface additives is present in an amount of from about 0.5 to about 3 weight percent or parts; a toner composition further containing wax, charge enhancing additive, and surface additives; a toner wherein the polyester R' represents the hydrophobic group, and S represents the hydrophilic group; a toner wherein at least one is two for the hydrophobic end group; a toner wherein at least one is from about 2 to about 10 for the hydrophilic moiety; a toner wherein at least one for the hydrophobic group is four; and toner compositions comprised of pigment or dye, and a polyester having chemically attached thereto a hydrophilic moiety such as an alkali sulfonate, especially an alkaline earth metal such as lithium, sodium, potassium, rubidium, cesium, berylium, magnesium, calcium, or barium, and hydrophobic end groups, such as an alkyl moiety comprised of a hydrocarbon, especially alkyl, preferably of from about 4 carbon atoms to about 120 carbon atoms.

Examples of polyester resins with hydrophobic end groups, preferably two, and hydrophilic groups that can be selected include polyesters with alkyl end groups of the formulas illustrated herein such as copoly(1,2-propylene-5-sulfoisophthalate sodio salt)-copoly(1,2-propylene terephthalate-co-diethylene terephthalate) end blocked with stearate, copoly(1,2-propylene-5-sulfoisophthalate sodio salt)-copoly(1,2-propylene terephthalate) end blocked with stearate, copoly(1,2-propylene-5-sulfoisophthalate sodio salt)-copoly(1,2-propylene terephthalate-co-diethylene terephthalate) end blocked with laurate, copoly(1,2-propylene-5-sulfoisophthalate sodio salt)-copoly(1,2-propylene terephthalate-co-diethylene terephthalate) end blocked with polyethylene, copoly(diethylene-5-sulfoisophthalate sodio salt)-copoly(1,2-propylene terephthalate-co-diethylene terephthalate) end blocked with octoate, copoly(1,2-propylene-5-sulfoisophthalate lithio salt)-copoly(1,2-propylene terephthalate-co-diethylene terephthalate) end blocked with a hexyl group, copoly(1,2-propylene-5-sulfoisophthalate potassio salt)-poly(1,2-propylene terephthalate-co-diethylene terephthalate) end blocked with a dodecyl group, copoly(1,2-propylene-5-sulfoisophthalate magnesio salt)-co-poly(1,2-propylene terephthalate-co-diethylene terephthalate) end blocked with a decyl group, copoly(1,2-propylene-5-sulfoisophthalate sodio salt)-copoly(1,2-propylene terephthalate-co-diethylene terephthalate) end blocked with a benzyl group, mixtures thereof, and the like; and which polyesters possess, for example, a number average molecular weight of from about 2,000 grams per mole to about 100,000, or about 20,000 to about 75,000 grams per mole, a weight average molecular weight, or from about 25,000 to about 125,000 of from about 4,000 grams per mole to about 250,000 grams per mole, and a polydispersity of from about 1.8 to about 17, all as measured by gel permeation chromatography.

The polyester resin with the hydrophilic moieties and hydrophobic end groups selected for the toner and developer compositions of the present invention, such as copoly(1,2-propylene-5-sulfoisophthalate sodio salt)-copoly(1,2-propylene terephthalate-co-diethylene terephthalate) end blocked with a polyethylene end group of about 45 carbon atoms, can be prepared by charging a 1 liter Parr reactor equipped with a mechanical stirrer and side condenser, with a mixture of from about 0.9 to about 0.95 mole of diester, such as dimethylterephthalate, from about 0.025 to about 0.05 mole of sulfonate monomer, such as dimethyl 5-sulfoisophthalate sodio salt, from about 1.75 moles to about 1.85 moles of a diol, such as 1,2-propanediol or diethylene glycol or a mixture of the diols, containing from about 0.15 to about 0.3 mole of diethylene glycol, from about 0.01 to about U.S. Pat. No. 4,883,736, the disclosure of which is totally incorporated herein by reference, (available from Petrolite Chemicals), and from about 0.001 mole to about 0.05 of a condensation catalyst such as butyltin oxide hydroxide. The reactor is subsequently heated, for example, to 170° C. for a suitable duration of, for example, from about 360 minutes to about 720 minutes with stirring at, for example, from about 10 revolutions per minute to about 200 revolutions per minute. During this time, from about 1.7 moles to about 1.9 moles of methanol byproduct can be collected through the condenser. The reactor temperature is then raised to about 220° C. and the pressure is reduced to about 1 Torr over a period of from about 2 hours to about 3 hours. The polymeric resin comprised of copoly(1,2-propylene-5-sulfoisophthalate sodio salt)-poly(1,2-propylene terephthalate-co-diethylene terephthalate) end blocked with polyethylene group of about 45 carbon atoms, is then discharged through the bottom of the reactor and cooled to room temperature.

Toners prepared with the polyester resins of the present invention can be obtained by admixing and heating the polyester resin particles such as copoly(1,2-propylene-5-sulfoisophthalate potassio salt)poly(1,2-propylene terephthalate-co-diethylene terephthalate) end blocked with polyethylene group of about 45 carbon atoms, and colorant particles such as magnetites, carbon black, or mixtures thereof, and preferably from about 0.20 percent to about 5 percent of optional charge enhancing additives, or mixtures of charge additives, and optionally wax in a melt mixing device, such as the ZSK53 extruder available from Werner Pfleiderer. After cooling, the toner composition is subjected to grinding utilizing, for example, a Sturtevant micronizer for the purpose of achieving toner particles with a volume median diameter of less than about 25 microns, and preferably from about 6 to about 12 microns, as determined by a Coulter Counter. The toner particles can be classified by utilizing, for example, a Donaldson Model B classifier for the purpose of removing fines, that is toner particles less than about 4 microns volume median diameter.

Specific examples of diols utilized in preparing the polyesters of the present invention include diols or glycols such as ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decylene glycol, dodecylene glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, mixtures thereof, and the like; and these glycols are employed in various effective amounts of, for example, from about 45 to about 55 mole percent of the polyester product resin.

Specific examples of diacids or diesters utilized in preparing the polyesters include malonic acid, succinic acid, 2-methylsuccinic acid, 2,3-dimethylsuccinic acid, dodecylsuccinic acid, glutaric acid, adipic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methyl itaconic acid, and dialkyl esters of these diacids and dianhydrides, wherein the alkyl groups of the dialkyl ester are of one carbon atom to about 5 carbon atoms and mixtures thereof, and the like, and which component is employed, for example, in amounts of from about 45 to about 55 mole percent of the resin.

Examples of polycondensation catalysts include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in effective amounts of from about 0.01 mole percent to about 5 mole percent based on the starting diacid or diester used to generate the polyester resin.

Monofunctional hydrophobic monomers which can be utilized for preparing the polyesters include monofunctional alcohols such as hexanol, heptanol, octanol, nonanol, decanol, undecanol, dodecanol, tridecanol, tetradecanol, pentadecanol, hexadecanol, heptadecanol, octadecanol, and other alcohols, such as those derived from components with about 6 to about 24 carbon atoms, oleyl alcohol, linoleyl alcohol, cinnamyl alcohol, alkyl substituted alcohols, such as 2-methylhexanol, 2,3,3-trimethylhexanol, 2-methyloctanol, 3,7-dimethyl-1,6-octadien-3-ol and the like, hydrophobic aromatic monomers such as benzyl alcohol, monofunctional acids such as hexanoic acid, heptanoic acid, octanoic acid, nonanoic acid, decanoic acid, stearic acid, lauric acid, palmitic acid, oleic acid, linoleic acid, cinnamic acid, and other alkyl acids, polyethylenealcohols or polypropylene alcohols such as Unilin 350, Unilin, 550, Unilin 700 and the like, such as those derived from components with about 20 to about 120 carbon atoms; and which monomers can be selected in effective amounts of from about 0.1 mole percent to about 4.0 mole percent based on the starting diacid or diester used to make the resin.

Examples of hydrophilic monomers, which can be utilized for the preparation of the polyester resin, include the ion salts of sulfonated difunctional monomers wherein the ion is an alkali or alkaline earth such as lithium, sodium, potassium, cesium, rubidium, magnesium, barium, calcium or berylium and the like, and the sulfonated difunctional moiety is selected from the group including dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethylsulfo-terephthalate, dialkyl-sulfo-terephthalate, sulfoethanediol, 2-sulfo-propanediol, 2-sulfo-butanediol, 3-sulfopentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, mixture thereof and the like. Effective hydrophilic amounts of, for example, from about 0.1 to about 2 weight percent of the resin can be selected.

Additionally, crosslinking or branching agents can be utilized, such as trifunctional or multifunctional monomers, which agents usually increase the molecular weight and polydispersity of the polyester, and which agents are selected from the group consisting of glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, mixtures thereof, and the like; and which agents can be selected in effective amounts of from about 0.1 mole percent to about 6.0 mole percent based on the starting diacid or diester used to make the resin.

Numerous well known suitable colorants, such as pigments or dyes can be selected as the colorant for the toner including, for example, cyan, magenta, yellow, red, blue, green, carbon black like REGAL 330®, nigrosine dye, aniline blue, phthalocyanines, magnetite, or mixtures thereof. A number of carbon blacks available from, for example, Cabot Corporation can be selected. The colorant, which is preferably carbon black, should be present in a sufficient amount to render the toner composition colored. Generally, the colorant is present in amounts of from about 1 percent by weight to about 20 percent by weight, and preferably from about 2 to about 10 weight percent based on the total weight of the toner composition, and wherein the total of all of the toner components is about 100 percent. Colorant includes dyes, pigments, mixtures thereof, mixtures of pigments, mixtures of dyes, and other suitable colorants that will impart a desired color to the toner. Dye examples include know suitable dyes, such as food dyes.

When the colorant particles are comprised of magnetites, thereby enabling single component magnetic toners in some instances, which magnetites are a mixture of iron oxides ($FeO.Fe_2O_3$) including those commercially available as MAPICO BLACK®, they are present in the toner composition in an amount of from about 10 percent by weight to about 80 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Charge additive examples include those as illustrated in U.S. Pat. No. 4,338,390, the disclosure of which is totally incorporated herein by reference, which additives preferably impart a positive charge to the toner composition; alkyl pyridinium compounds as disclosed in U.S. Pat. No. 4,298,672, the disclosure of which is totally incorporated herein by reference, the charge control additives as illustrated in U.S. Pat. Nos. 3,944,493; 4,007,293; 4,079,014; 4,394,430, and 4,560,635, which illustrates a toner with a distearyl dimethyl ammonium methyl sulfate charge additive, bisulfates, silicas, and other known toner charge additives. Negative charge additives can also be selected, such as zinc or aluminum complexes, like an aluminum compound of a hydroxy carboxylic acid (BONTRON E-88® from Orient Chemical Company), the zinc complex of 3,5-ditertiary butyl salicylate (BONTRON E-84® from Orient Chemical Company) and hydroxy bis(3,5-ditertiary butyl salicylic) aluminate monohydrate (Alohas), and the like.

There can be included in the toner compositions of the present invention compatibilizers, such as those illustrated in U.S. Pat. No. 5,229,242, the disclosure of which is totally incorporated herein by reference, waxes, or mixtures thereof, such as polypropylenes and polyethylenes such as EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected are believed to possess a molecular weight $M_w$, of from about 1,000 to about 3,000, such as those obtainable from Petrolite Corporation, while the commercially available polypropylenes utilized for the toner compositions of the present invention are believed to possess a molecular weight $M_w$ of from about 4,000 to about 5,000. Many of the alkylenes like polyethylene and polypropylene compositions are illustrated in British Patent No. 1,442,835, the disclosure of which is totally incorporated herein by reference. The wax is present in the toner composition of the present invention in various amounts; generally the wax is present in the toner composition in an amount of from about 1 percent by weight to about 15 percent by weight, and preferably in an amount of from about 2 percent by weight to about 10 percent by weight.

There can also be blended with the toner compositions of the present invention toner additives, such as external additive particles including flow aid additives, which additives are usually present on the surface thereof. Examples of these additives include metal oxides, such as aluminum oxide, titanium oxide, tin oxide, cerium oxide mixtures thereof, and the like, colloidal fumed silicas, such as AEROSIL®, or Cabosil®, coated silicas, reference, for example, U.S. Ser. No. 08/131,188 and U.S. Ser. No. 08/132,623, the disclosures of which are totally incorporated herein by reference, metal salts and metal salts of fatty acids including zinc stearate, magnesium stearate, polymeric components such as polyvinylidene fluoride which is obtainable from ATOCHEM North America, Inc, polytetrafluoroethylene available from ICI Advanced Materials, or polymeric microspheres of from 0.1 to 2.0 microns, such as those obtainable from Nippon Paint, Osaka, Japan, and mixtures thereof, which additives are each generally present in an amount of from about 0.1 percent by weight to about 5 percent by weight, and preferably in an amount of from about 0.1 percent by weight to about 3 percent by weight. A number of toner additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with known charge additives, such as DDAMS (distearyldimethyl ammonium methyl sulfate), in an amount of from about 1 to about 30 weight percent and preferably 10 weight percent, followed by the addition thereof to the toner in an amount of from 0.1 to 10, and preferably 0.1 to 1 weight percent.

Encompassed within the scope of the present invention are colored toner and developer compositions comprised of toner polyester resin particles, and as colorants red, blue, green, brown, magenta, cyan and/or yellow particles, as well as mixtures thereof. More specifically, with regard to the generation of color images, illustrative examples of magentas that may be selected include, for example, 2,9-dimethyl-substituted quinacridone identified in the Color Index as CI 73915, Pigment Red 122, anthraquinone dye identified in the Color Index as CI 60710, CI Dispersed Red 15, diazo dye identified in the Color Index as CI 26050, CI Solvent Red 19, and the like; examples of cyans that may be selected include copper tetra-4-(octadecyl sulfonamido) phthalocyanine, beta-copper phthalocyanine pigment listed in the Color Index as CI 74160 Pigment Blue 15.3 and Anthrathrene Blue, identified in the Color Index as CI 69810, Special Blue X-2137, and the like; and illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. These colorants are incorporated into the toner composition in various suitable effective amounts such as from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative or positive polarity enabling the toner particles, which are oppositely charged, to adhere to and surround the carrier particles. Illustrative examples of carrier particles include iron powder, steel, nickel, iron, ferrites, including copper zinc ferrites, strontium ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances, such as carbon black, in an amount of, for example, from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including, for example, KYNAR® and polymethylmethacrylate mixtures like 40/60. Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 35 microns to about 1,000 and preferably from about 50 to about 200 microns in diameter, thereby permitting them to, for example, possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier, are selected.

The toner and developer compositions of the present invention may be selected for use in electrostatographic imaging apparatuses containing therein photoconductive imaging members, such as those illustrated in U.S. Pat. Nos. 5,534,376; 5,456,998; 5,466,796; 5,563,261, 5,645,965, metal phthalocyanines, metal free phthalocyanines, perylenes, titanyl phthalocyanines, and the like. Thus, the toner and developer compositions of the present invention can be used with layered photoreceptors that are capable of being charged negatively, or positively, such as those described in U.S. Pat. Nos. 4,265,990; 4,585,884; 4,584,253; 4,563,408, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar suitable known photoreceptors or photoconductive imaging members can be selected.

The toner compositions are usually jetted and classified subsequent to preparation to enable toner particles with a preferred average diameter of from about 5 to about 25 microns, and more preferably from about 6 to about 12 microns. Also, the toner compositions of the present invention preferably possess a triboelectric charge of from about 5 to 40 microcoulombs per gram in embodiments thereof as determined by the known charge spectograph. Admix time for the toners of the present invention are preferably from about 15 seconds to 1 minute, and more specifically, from about 15 to about 30 seconds in embodiments thereof as determined by the known charge spectograph. These toner compositions with rapid admix characteristics enable, for example, the development of latent electrostatographic images in electrophotographic imaging apparatuses, which developed images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Weight percent in embodiments refers to the total amount of components, especially solids, divided into the specific component and multiplied by 100. For example, the weight percent of colorant, such as pigment can be calculated by subtracting the amount of pigment from the amount of pigment and resin and dividing the result by the amount of resin and pigment, and then multiplying by 100.

The following Examples are being supplied to further define various species of the present invention, it being noted that these Examples are intended to illustrate and not limit the scope of the present invention. Parts and percentages are by weight unless otherwise indicated.

EXAMPLE I

Copoly(1,2-propylene terephthalate-co-diethylene terephthalate)-copoly(1,2-propylene 5-sulfo-isophthalate-co-diethylene 5-sulfo-isophthalate) end blocked with polyethylene, derived from dimethyl terephthalate, 2 mole percent by weight of Unilin 700, and 1 mole percent by weight of dimethyl 5-sulfo isophthalate sodium salt, was prepared as follows.

A 2 liter Parr reactor equipped with a bottom drain valve, double turbine agitator and distillation receiver with a cold water condenser was charged with 690 grams of dimethylterephthalate, 8.6 grams of dimethyl 5-sulfo isophthalate sodium salt, 460 grams of 1,2-propanediol, 113 grams of diethylene glycol, 24.6 grams of Unilin 700 obtained from Petrolite, reference for example U.S. Pat. No. 4,883,736, the disclosure of which is totally incorporated herein by reference, and 1.6 grams of butyltin oxide catalyst obtained as FASCAT 4100™ from Elf Atochem North America, Inc. The reactor was then heated to 165° C. with stirring at 150 revolutions per minute and then heated to 200° C. over a duration of 6 hours, wherein a methanol byproduct (228 grams) was collected via the distillation receiver to a container, and which byproduct was comprised of about 98 percent by volume of methanol and 2 percent by volume of 1,2-propanediol as measured by the ABBE refractometer available from American Optical Corporation. The reactor mixture was then maintained at 200° C., and the pressure was reduced from atmospheric to about 0.2 Torr over a duration of about 3 hours. During this time, there were further collected approximately 286.5 grams of glycol with about 97 percent by volume of 1,2-propanediol and 3 percent by volume of methanol as measured by the ABBE refractometer. The reactor was then purged with nitrogen to atmospheric pressure, and the polymer discharged through the bottom drain onto a container cooled with dry ice to yield 1.13 kilograms of copoly(1,2-propylene terephthalate-co-diethylene terephthalate)-copoly(1,2-propylene 5-sulfoisophthalate-co-diethylene 5-sulfo-isophthalate) end blocked with polyethylene derived from Unilin 700.

The above resulting resin product glass transition temperature was measured to be 59° C. (onset) utilizing the 910 Differential Scanning Calorimeter available from E.I. DuPont operating at a heating rate of 10° C. per minute. The number average molecular weight of the polyester product resin was measured to be 4,100 grams per mole and the weight average molecular weight was measured to be 11,000 grams per mole using tetrahydrofuran as the solvent and obtained with the 700 Satellite WISP gel permeation chromatograph available from Waters Company equipped with a styrogel column. For the polyester resin of this Example, a softening point of 130.9° C. was obtained using the Mettler Flow tester. The acid number of the polyester resin was found to be 2.0 milliequivalent per gram of potassium hydroxide.

EXAMPLE II

Copoly(1,2-propylene terephthalate-co-diethylene terephthalate)-copoly(1,2-propylene 5-sulfo-isophthalate-co-diethylene 5-sulfo-isophthalate) end blocked with polyethylene, derived from terephthalic acid, 2 mole percent by weight of Unilin 700, and 1 mole percent by weight of dimethyl 5-sulfo-isophthalate sodium salt, was prepared as follows.

A 2 liter Parr reactor equipped with a bottom drain valve, double turbine agitator and distillation receiver with a cold water condenser was charged with 589 grams of terephthalic acid, 8.6 grams of dimethyl 5-sulfo-isophthalate sodium salt, 484 grams of 1,2-propanediol, 94.5 grams of diethylene glycol, 24.6 grams of Unilin 700, and 1.7 grams of butyltin oxide catalyst obtained as FASCAT 4100™ from Elf Atochem North America, Inc. The reactor was then pressurized to 300 kilopascals with nitrogen, and heated to 240° C. with stirring at 150 revolutions per minute over a duration of 4 hours, wherein the pressure of the reactor was maintained at from about 287 to about 314 kilopascals, and wherein the water byproduct (93 grams) was collected via the distillation receiver to a container, and which byproduct was comprised of about 99 percent by volume of water and 1 percent by volume of 1,2-propanediol as measured by the ABBE refractometer available from American Optical Corporation. The reaction temperature was then decreased to about 205° C., and the pressure was reduced to atmospheric pressure (about 101 kilopascals) over a duration of about 1 hours. During this time, there were further collected approximately 5 grams of water. The pressure of the reactor was then reduced from atmospheric pressure to about 6 Torrs over a 3 hour period and wherein about 150 grams of glycol was collected. The polymer product, was then discharged through the bottom drain onto a container cooled with dry ice to yield 1.05 kilograms of copoly(1,2-propylene terephthalate-co-diethylene terephthalate)-copoly(1,2-propylene 5-sulfo-isophthalate-co-diethylene 5-sulfo-isophthalate) end blocked with polyethylene derived from Unilin 700.

The above resulting resin product glass transition temperature was measured to be 62.9° C. (onset) utilizing the 910 Differential Scanning Calorimeter available from E.I. DuPont operating at a heating rate of 10° C. per minute. The number average molecular weight of the polyester product resin was measured to be 5,600 grams per mole and the weight average molecular weight was measured to be 12,700 grams per mole using tetrahydrofuran as the solvent and obtained with the 700 Satellite WISP gel permeation chromatograph available from Waters Company equipped with a styrogel column. For the polyester resin of this Example, a softening point of 130.4° C. was obtained using the Mettler Flow tester. The acid number of the polyester resin product was found to 1.9 milliequivalent per gram of potassium hydroxide.

EXAMPLE III

Copoly(1,2-propylene terephthalate-co-diethylene terephthalate)-copoly(1,2-propylene 5-sulfo-isophthalate-co-diethylene 5-sulfo-isophthalate) end blocked with polyethylene, derived from terephthalic acid, 2 mole percent by weight of Unilin 700, and 2 mole percent by weight of dimethyl 5-sulfo isophthalate sodium salt, was prepared as follows.

A 2 liter Parr reactor equipped with a bottom drain valve, double turbine agitator and distillation receiver with a cold water condenser was charged with 583 grams of terephthalic acid, 17.2 grams of dimethyl 5-sulfo-isophthalate sodium salt, 484 grams of 1,2-propanediol, 94.5 grams of diethylene glycol, 24.6 grams of Unilin 700, and 1.7 grams of butyltin oxide catalyst obtained as FASCAT 4100™ from Elf Atochem North America, Inc. The reactor was then pressurized to 300 Kilopascals with nitrogen, and heated to 240° C. with stirring at 150 revolutions per minute over a duration of 4 hours, wherein the pressure of the reactor was maintained at from about 287 to about 314 kilopascals, and wherein the water byproduct (93 grams) was collected via the distillation receiver to a container, and was comprised of about 99 percent by volume of water and 1 percent by volume of 1,2-propanediol as measured by the ABBE refractometer available from American Optical Corporation. The reaction temperature was then decreased to about 205° C., and the pressure was reduced to atmospheric pressure (about 101 Kilopascals) over a duration of about 1 hours. During this time, there were further collected approximately 5 grams of water. The pressure of the reactor was then reduced from atmospheric pressure to about 6 Torrs over a 3 hour period and wherein about 150 grams of glycol was collected. The polymer product, was then discharged through the bottom drain of the reactor onto a container cooled with dry ice to yield 1.05 kilograms of copoly(1,2-propylene terephthalate-co-diethylene terephthalate)-copoly(1,2-propylene 5-sulfo-isophthalate-co-diethylene 5-sulfo-isophthalate) end blocked with polyethylene derived from Unilin 700.

The above resulting resin product glass transition temperature was measured to be 55.7° C. (onset) utilizing the 910 Differential Scanning Calorimeter available from E.I. DuPont operating at a heating rate of 10° C. per minute. The number average molecular weight of the polyester product resin was measured to be 3,300 grams per mole and the weight average molecular weight was measured to be 10,500 grams per mole using tetrahydrofuran as the solvent and obtained with the 700 Satellite WISP gel permeation chromatograph available from Waters Company equipped with a styrogel column. For the polyester resin of this Example, a softening point of 134° C. was obtained using the Mettler Flow tester. The acid number of the polyester resin product was found to be 2.5 milliequivalents per gram of potassium hydroxide.

EXAMPLE IV

Copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene, derived from terephthalic acid, 2 mole percent by weight of Unilin 700, and 1 mole percent by weight of dimethyl 5-sulfo-isophthalate sodium salt, and 0.75 mole percent of trimethylolpropane as the branching agent was prepared as follows.

A 2 liter Parr reactor equipped with a bottom drain valve, double turbine agitator and distillation receiver with a cold water condenser was charged with 778.7 grams of terephthalic acid, 11.4 grams of dimethyl 5-sulfo-isophthalate sodium salt, 638.9 grams of 1,2-propanediol, 124.7 grams of diethylene glycol, 32.5 grams of Unilin 700, 12.5 grams of trimethylolpropane, and 1.7 grams of butyltin oxide catalyst obtained as FASCAT 4100™ from Elf Atochem North America, Inc. The reactor was then pressurized to 300 Kilopascals with nitrogen, and heated to 240° C. with stirring at 150 revolutions per minute over a duration of 4 hours, wherein the pressure of the reactor was maintained at from about 287 to about 314 kilopascals, and wherein the water byproduct (179 grams) was collected via the distillation receiver to a container, and was comprised of about 99 percent by volume of water and 1 percent by volume of 1,2-propanediol as measured by the ABBE refractometer available from American Optical Corporation. The reaction temperature was then decreased to about 205° C., and the pressure was reduced to atmospheric pressure (about 101 kilopascals) over a duration of about 1 hours. During this time, there were further collected approximately 6 grams of water. The pressure of the reactor was then reduced from atmospheric pressure to about 6 Torrs over a 3 hour period and wherein about 264.5 grams of glycol was collected. The polymer product, was then discharged through the bottom drain onto a container cooled with dry ice to yield 1.03 kilograms of copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene derived from Unilin 700.

The above resulting resin product glass transition temperature was measured to be 58.2° C. (onset) utilizing the 910 Differential Scanning Calorimeter available from E.I. DuPont operating at a heating rate of 10° C. per minute. The number average molecular weight of the polyester product resin was measured to be 3,500 grams per mole and the weight average molecular weight was measured to be 15,500 grams per mole using tetrahydrofuran as the solvent and obtained with the 700 Satellite WISP gel permeation chromatograph available from Waters Company equipped with a styrogel column. For the polyester resin of this Example, a softening point of 132° C. was obtained using the Mettler Flow tester. The acid number of the polyester resin was found to be 2.2 milliequivalents per gram of potassium hydroxide.

EXAMPLE V

Copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene, derived from terephthalic acid, 2 mole percent by weight of Unilin 700, and 1 mole percent by weight of dimethyl 5-sulfo isophthalate sodium salt, and 1.5 mole percent of trimethylolpropane as the branching agent was prepared as follows.

A 2 liter Parr reactor equipped with a bottom drain valve, double turbine agitator and distillation receiver with a cold water condenser was charged with 778.7 grams of terephthalic acid, 11.4 grams of dimethyl 5-sulfo-isophthalate sodium salt, 638.9 grams of 1,2-propanediol, 124.7 grams of diethylene glycol, 32.5 grams of Unilin 700, 25 grams of trimethylolpropane, and 1.7 grams of butyltin oxide catalyst obtained as FASCAT 4100™ from Elf Atochem North America, Inc. The reactor was then pressurized to 300 kilopascals with nitrogen, and heated to 240° C. with stirring at 150 revolutions per minute over a duration of 4 hours, wherein the pressure of the reactor was maintained at from about 287 to about 314 kilopascals, and wherein the water byproduct (179 grams) was collected via the distillation receiver to a container, and was comprised of about 99 percent by volume of water and 1 percent by volume of 1,2-propanediol as measured by the ABBE refractometer available from American Optical Corporation. The reaction temperature was then decreased to about 205° C., and the pressure was reduced to atmospheric pressure (about 101 kilopascals) over a duration of about 1 hours. During this time, there were further collected approximately 6 grams of water. The pressure of the reactor was then reduced from atmospheric pressure to about 6 Torrs over a 3 hour period and wherein about 264.5 grams of glycol was collected. The polymer product, was then discharged through the bottom drain onto a container cooled with dry ice to yield 1.03 kilograms of copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene derived from Unilin 700.

The above resulting resin product glass transition temperature was measured to be 54.6° C. (onset) utilizing the 910 Differential Scanning Calorimeter available from E.I. DuPont operating at a heating rate of 10° C. per minute. The number average molecular weight of the polyester product resin was measured to be 3,800 grams per mole and the weight average molecular weight was measured to be 18,900 grams per mole using tetrahydrofuran as the solvent and obtained with the 700 Satellite WISP gel permeation chromatograph available from Waters Company equipped with a styrogel column. For the polyester resin of this Example, a softening point of 132° C. was obtained using the Mettler Flow tester. The acid number of the polyester resin was found to be 2.1 milliequivalents per gram of potassium hydroxide.

EXAMPLE VI

Copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene, derived from terephthalic acid, 2 mole percent by weight of Unilin 700, and 3 mole percent by weight of dimethyl 5-sulfo isophthalate sodium salt, and 1.5 mole percent of trimethylolpropane as the branching agent was prepared as follows.

A 2 liter Parr reactor equipped with a bottom drain valve, double turbine agitator and distillation receiver with a cold water condenser was charged with 754 grams of terephthalic acid, 34.2 grams of dimethyl 5-sulfo-isophthalate sodium salt, 638.9 grams of 1,2-propanediol, 124.7 grams of diethylene glycol, 32.5 grams of Unilin 700, 25 grams of trimethylolpropane, and 1.7 grams of butyltin oxide catalyst obtained as FASCAT 4100™ from Elf Atochem North America, Inc. The reactor was then pressurized to 300 kilopascals with nitrogen, and heated to 240° C. with stirring at 150 revolutions per minute over a duration of 4 hours, wherein the pressure of the reactor was maintained at from about 287 to about 314 kilopascals, and wherein the water byproduct (179 grams) was collected via the distillation receiver to a container, and was comprised of about 99 percent by volume of water and 1 percent by volume of 1,2-propanediol as measured by the ABBE refractometer available from American Optical Corporation. The reaction temperature was then decreased to about 205° C., and the pressure was reduced to atmospheric pressure (about 101 kilopascals) over a duration of about 1 hours. During this time, there were further collected approximately 6 grams of water. The pressure of the reactor was then reduced from atmospheric pressure to about 6 Torrs over a 3 hour period and wherein about 264.5 grams of glycol was collected. The polymer product, was then discharged through the bottom drain onto a container cooled with dry ice to yield 1.03 kilograms of copoly(1,2-propylene terephthalate-co-diethylene terephthalate)-copoly(1,2-propylene 5-sulfo-isophthalate-co-diethylene 5-sulfo-isophthalate)-copoly (trimethylolpropane-terephthalate) end blocked with polyethylene derived from Unilin 700.

The resulting above resin product glass transition temperature was measured to be 58.7° C. (onset) utilizing the 910 Differential Scanning Calorimeter available from E.I. DuPont operating at a heating rate of 10° C. per minute. The number average molecular weight of the polyester product resin was measured to be 3,300 grams per mole and the weight average molecular weight was measured to be 14,700 grams per mole using tetrahydrofuran as the solvent and obtained with the 700 Satellite WISP gel permeation chromatograph available from Waters Company equipped with a styrogel column. For the polyester resin of this Example, a softening point of 161° C. was obtained using the Mettler Flow tester. The acid number of the polyester resin was found to be 2.0 milliequivalents per gram of potassium hydroxide.

Comparative Example VII

Copoly(1,2-propylene-diethylene terephthalate)-copoly (1,2-propylene-diethylene-5-) sodium salt, and with no hydrophobic end groups are present, was prepared as follows.

A 2 liter Parr reactor equipped with a bottom drain valve, double turbine agitator and distillation receiver with a cold water condenser was charged with 690 grams of dimethylterephthalate, 8.6 grams of dimethyl 5-sulfo isophthalate sodium salt, 460 grams of 1,2-propanediol, 113 grams of diethylene glycol, and 1.6 grams of butyltin oxide catalyst obtained as FASCAT 4100™ from Elf Atochem North America, Inc. The reactor was then heated to 165° C. with stirring at 150 revolutions per minute and then heated to 200° C. over a duration of 6 hours, wherein the methanol byproduct (228 grams) was collected via the distillation receiver to a container, and which byproduct was comprised of about 98 percent by volume of methanol and 2 percent by volume of 1,2-propanediol as measured by the ABBE refractometer available from American Optical Corporation. The mixture was then maintained at 200° C., and the pressure was reduced from atmospheric to about 0.2 Torr over a duration of about 3 hours. During this time, there were further collected approximately 286.5 grams of glycol with about 97 percent by volume of 1,2-propanediol and 3 percent by volume of methanol as measured by the ABBE refractometer. The reactor was then purged with nitrogen to atmospheric pressure, and the polymer discharged through the bottom drain onto a container cooled with dry ice to yield 1.13 kilograms of copoly(1,2-propylene terephthalate-co-diethylene terephthalate)-copoly(1,2-propylene 5-sulfo-isophthalate-co-diethylene 5-sulfo-isophthalate) end blocked with polyethylene derived from Unilin 700.

The above resulting resin product glass transition temperature was measured to be 58° C. (onset) utilizing the 910 Differential Scanning Calorimeter available from E.I. DuPont operating at a heating rate of 10° C. per minute. The number average molecular weight of the polyester product resin was measured to be 4,500 grams per mole and the weight average molecular weight was measured to be 10,000 grams per mole using tetrahydrofuran as the solvent and obtained with the 700 Satellite WISP gel permeation chromatograph available from Waters Company equipped with a styrogel column. For the polyester resin of this Example, a softening point of 130° C. was obtained using the Mettler Flow tester. The acid number of the polyester resin was found to be 12 milliequivalents per gram of potassium hydroxide.

Comparative Example VIII

Copoly(1,2-propylene terephthalate-co-diethylene terephthalate-co-1,1,1-trimethylene propane terephthalate) resin with no hydrophylic moieties and/or no hydrophobic end groups was prepared as follows.

A 7.6 liter Parr reactor equipped with a bottom drain valve, double turbine agitator and distillation receiver with a cold water condenser was charged with 3,250 grams of dimethylterephthalate, 2,228.8 grams of 1,2-propanediol (1 equivalent excess), 443.1 grams of diethylene glycol, 44.8 grams of trimethylol propane and 4.7 grams of butyltin oxide catalyst obtained as FASCAT 4100™ from Elf Atochem North America, Inc. The reactor was then heated to 165° C. with stirring at 150 revolutions per minute and then heated to 200° C. over a duration of 6 hours, wherein the methanol byproduct (809 grams) was collected via the distillation receiver to a container comprised of about 98 percent by volume of methanol and 2 percent by volume of 1,2-propanediol as measured by the ABBE refractometer available from American Optical Corporation. The reactor mixture was then maintained at 200° C., and the pressure was reduced from atmospheric to about 0.2 Torr over a duration of about 3 hours. During this time, there were further collected approximately 1,240 grams of distillate in the distillation receiver comprised of approximately 97 percent by volume of 1,2-propanediol and 3 percent by volume of methanol as measured by the ABBE refractometer. The pressure was then further maintained at about 0.2 Torr and the temperature of the reaction mixture increased to 210° C. for an additional 2 hours, wherein an additional 30 grams of 1,2-propanediol were collected. The reactor was then purged with nitrogen to atmospheric pressure, and the polymer discharged through the bottom drain onto a container cooled with dry ice to yield 3.7 kilograms of poly(1,2-propylene terephthalate-co-diethylene terephthalate-co-1,1,1-trimethylene propane terephthalate) resin. The resin glass transition temperature was measured to be 57.2° C. (onset) utilizing the 910 Differential Scanning Calorimeter available from E.I. DuPont operating at a heating rate of 10° C. per minute. The number average molecular weight was measured to be 10,100 grams per mole and the weight average molecular weight was measured to be 34,000 grams per mole using tetrahydrofuran as the solvent and obtained with the 700 Satellite WISP gel permeation chromatograph available from Waters Company equipped with a styrogel column. The melt index of the resin of this Example was found to be 17 grams per 10 minute at 117° C. with a loading of 16.6 kilograms. The acid number of the polyester resin was found to be 16 milliequivalent per gram of potassium hydroxide.

EXAMPLES IX to XVI

A toner composition comprised of 95 percent by weight of the polyester resin of Example I to Examples VIII and 5 percent by weight of REGAL 330® pigment was prepared as follows.

The polyester resin of Example I to Comparative Example VIII was ground to about 500 microns average volume diameter in a Model J Fitzmill equipped with an 850 micrometer screen. After grinding, 950 grams (95 percent by weight of toner) of the polyester polymer were mixed with 50 grams of REGAL 330® carbon black pigment (5 percent by weight of toner). The two components were dry blended first on a paint shaker and then on a roll mill. A Davo twin screw extruder was then used to melt mix the aforementioned mixture at a barrel temperature of 140° C., screw rotational speed of 50 rpm and at a feed rate of 20 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 9.1 microns with a geometric distribution of 1.43 as measured by the Coulter Counter. The resulting toner was then utilized without further classification.

A developer composition was prepared by roll milling the above prepared toners, 3 parts by weight, with 100 parts by weight of a 90 micron diameter ferrite carrier core with a coating, 0.55 percent by weight of a polymer of methylmethacrylate (80.4 percent), vinyl triethoxysilane (5 percent) and styrene (14.1 percent). The tribo data was obtained using the known blow-off Faraday Cage apparatus. The toner/developer was subjected to 80 percent humidity in a chamber for 48 hours at 80° F. to result in a triboelectric charge of −15 microcoulombs per gram, and at 20 percent humidity level in a chamber for 48 hours at 60° F. to result in a triboelectric charge of −33 microcoulombs per gram. The ratio of the corresponding triboelectric charge at 20 percent RH to 80 percent RH as calculated by Equation 1 was measured to be 2.2 for a number of the invention toners. Unfused copies were then produced using a custom made imaging apparatus similar to the Xerox Corporation 9200 imaging apparatus with the fusing system disabled. The unfused copies were then fused in the 5090 fuser. The triboelectric values, fusing data, and other information is listed in Table 1.

TABLE 1

| | | Triboelectric | | Fusing | |
|---|---|---|---|---|---|
| Toner | Resin | RH | Admix (Second) | MFT ° C. | FL ° C. |
| Example IX | Example I | 2.1 | <30 | 135 | 70 |
| Example X | Example II | 2.4 | <30 | 140 | 70 |
| Example XI | Example III | 2.2 | <30 | 140 | 80 |
| Example XII | Example IV | 2.3 | <30 | 138 | 80 |
| Example XIII | Example V | 2.4 | <30 | 135 | 85 |
| Example XIV | Example VI | 2.5 | <30 | 140 | 90 |
| Comparative Example XV | Comparative Example VII | 2.8 | >60 | 138 | 55 |
| Comparative Example XVI | Comparative Example VIII | 4.2 | >60 | 140 | 50 |

MFT = Minimum Fixing Temperature
FL = Fusing Latitude
RH = relative humidity sensitivity Toners of Examples IX to XV all are derived from polyester resins comprised of both hydrophilic moieties and hydrophobic end groups, and which toner enabled excellent RH sensitivity such as from about 2.1 to 2.5, excellent admix, such as less than about 30 seconds, low minimum fixing temperature (MFT), such as from about 135° C. to about 140° C., and broad fusing latitude, such as from about 70 to 90° C. Comparative Example XV, wherein the polyester resin was derived from Comparative Example VII containing no hydrophobic end groups indicated a higher RH sensitivity of 2.8, and slow admix of greater than 60 seconds, and although there was obtained low MFT of about 140° C., the fusing latitude was about 55° C. and narrower than the inventive Examples IX to XIV of the present invention. Comparative Example XVI, wherein the polyester resin was derived from Comparative Example VIII containing no hydrophilic moieties or hydrophobic end groups possessed a higher RH sensitivity of 4.2, and slow admix of greater than about 60 seconds. Although there was obtained low MFT of about 140° C., the fusing latitude was about 50° C. and narrower than the inventive Examples IX to XIV of the present invention.

Other embodiments and modifications of the present invention may occur to those of skill in this art subsequent to a review of the present application and the information presented herein; these embodiments and modifications, as well as equivalents thereof, are also included within the scope of this invention.

What is claimed is:

1. A toner composition comprised of a polyester resin with hydrophilic moieties, or groups and hydrophobic end groups, colorant, optional wax, optional charge additive, and optional surface additives.

2. A toner composition comprised of a polyester resin containing hydrophobic end groups, at least one hydrophobic group, and colorant.

3. A toner composition in accordance with claim 2 wherein the polyester resin is derived from at least one organic diol monomer, at least one organic diacid or diester monomer, and at least one hydrophobic monofunctional alcohol or monofunctional acid monomer, at least one alkali or alkaline earth metal salt of alkylene sulfonate, an arylene sulfonate diacid, or diester monomer.

4. A toner composition in accordance with claim 2 wherein the polyester resin is of the formulas

I

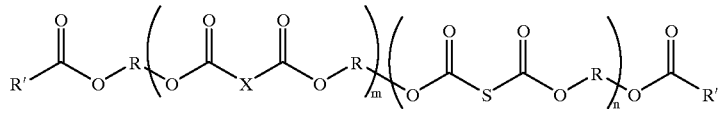

II

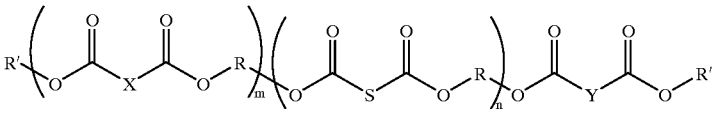

III

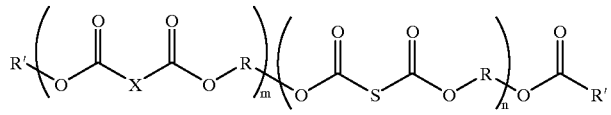

wherein R is a hydrocarbon; X is arylene, an olefinic group or groups, or an alkylene; R' is alkyl or alkylene; and m and n represent the number of random segments; S is a hydrophilic group, Y is equivalent to X or S.

5. A toner composition in accordance with claim 4 wherein R is an alkylene.

6. A toner composition in accordance with claim 4 wherein R is alkylene with from about 2 to about 20 carbon atoms.

7. A toner composition in accordance with claim 4 wherein said hydrocarbon possesses from about 2 to about 22 carbon atoms.

8. A toner composition in accordance with claim 4 wherein R is cyclohexylene.

9. A toner composition in accordance with claim 4 wherein R is 1,4-dimethyl cyclohexylene.

10. A toner composition in accordance with claim 4 wherein R is ethylene, propylene, butylene, or ethyleneoxyethylene.

11. A toner composition in accordance with claim 4 wherein said X arylene possesses from about 6 to about 30 carbon atoms.

12. A toner composition in accordance with claim 4 wherein X is phenylene.

13. A toner composition in accordance with claim 4 wherein X is phthalylene.

14. A toner composition in accordance with claim 4 wherein X is terephthalylene.

15. A toner composition in accordance with claim 4 wherein X is isophthalylene.

16. A toner composition in accordance with claim 4 wherein said X olefinic group possesses from about 2 to about 12 carbon atoms.

17. A toner composition in accordance with claim 4 wherein said X olefinic group is vinylene.

18. A toner composition in accordance with claim 4 wherein said X olefinic group is methylvinylene.

19. A toner composition in accordance with claim 4 wherein said X alkylene possesses from about 2 to about 20 carbon atoms.

20. A toner composition in accordance with claim 4 wherein said X alkylene is ethylene, propylene, butylene, pentylene or hexylene.

21. A toner composition in accordance with claim 4 wherein R' alkyl contains from 1 to about 120 carbon atoms.

22. A toner composition in accordance with claim 4 wherein R' alkyl contains from about 5 to about 30 carbon atoms.

23. A toner composition in accordance with claim 4 wherein said R' alkyl is hexyl, heptyl, octyl, lauryl or stearyl.

24. A toner composition in accordance with claim 4 wherein said R' alkylene is polyethylene or polypropylene.

25. A toner composition in accordance with claim 4 wherein m is a number of from about 20 to about 2,000.

26. A toner composition in accordance with claim 4 wherein m is a number of from about 50 to about 125.

27. A toner composition in accordance with claim 4 wherein n is a number of from about 1 to about 100.

28. A toner composition in accordance with claim 4 wherein n is a number of from about 50 to about 125.

29. A toner composition in accordance with claim 4 wherein m is a number of from about 100 to about 500, n is a number of from about 15 to about 25, and wherein m is 20 times the value of n.

30. A toner composition in accordance with claim 4 wherein S is an alkali earth metal salt of an arylene sulfonate.

31. A toner composition in accordance with claim 4 wherein S is an alkali earth metal salt of an alkylene sulfonate.

32. A toner composition in accordance with claim 4 wherein S is an alkaline earth metal salt of an arylene sulfonate, and wherein said metal is lithium, sodium, potassium, cesium, berylium, magnesium, calcium or barium.

33. A toner composition in accordance with claim 4 wherein X is an alkali earth metal salt of phenylene sulfonate.

34. A toner composition in accordance with claim 4 wherein S is an alkali metal salt of isophthalylene 5-sulfonate, terephthalylene sulfonate, or alkylene sulfonate.

35. A toner composition in accordance with claim 4 wherein R' and X are methylene, propylene, ethylene, butylene, pentylene, hexylene, or heptylene.

36. A toner composition in accordance with claim 4 wherein the polyester resin is further comprised of an additional branching segment, p or q, as illustrated by the formulas

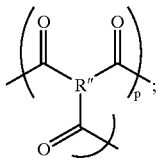

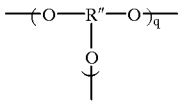

wherein R" is a trivalent aromatic or aliphatic radical with from about 3 to about 20 carbon atoms; and p and q represent the branching segment and are from about 0.1 to about 6 mole percent based on the starting diacid or diester used to prepare the resin, and wherein the sum of segments p and q is 100 mole percent of the polyester resin.

37. A toner composition in accordance with claim 36 wherein R" is the trivalent derivatives of propane, butane, pentane, hexane, cyclohexane, heptane, octane, benzene, naphthalene, or anthracene.

38. A toner composition in accordance with claim 36 wherein p and q each are from about 0.1 to about 6 mole percent based on the diacid or diester reactant selected for the preparation of said polyester.

39. A toner composition in accordance with claim 4 wherein the polyester resin is further comprised of an additional branching segment, r or s, as illustrated by the formulas

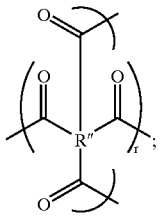

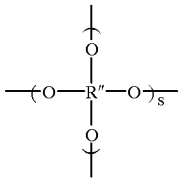

wherein R" is multifunctional radical, and wherein the sum of segments r and s are 100 mole percent of the polyester resin.

40. A toner composition in accordance with claim 39 wherein R" is a polyvalent or tetravalent aromatic or aliphatic radical with from about 3 to about 20 carbon atoms for said aliphatic, and from about 6 to about 30 for said aromatic; and r and s represent the branching segment and are from about 0.1 to about 6 mole percent based on the starting diacid or diester.

41. A toner composition in accordance with claim 2 wherein hydrophobic groups are end groups of poly(1,2-propylene terephthalate-co-diethylene terephthalate) end blocked with an alkyl group of stearyl or stearate, poly(1,2-propylene terephthalate-co-diethylene terephthalate-co-1,1,1-trimethylene propane terephthalate) end blocked with an alkyl group of stearyl or stearate, poly(1,2-propylene terephthalate) end blocked with an alkyl group such as stearyl or stearate, poly(1,2-propylene terephthalate-co-diethylene terephthalate) end blocked with alkyl group of lauryl or laurate, poly(1,2-propylene terephthalate-co-diethylene terephthalate) end blocked with an alkyl group of cetyl or pailmitate, poly(1,2-propylene terephthalate-co-diethylene terephthalate) end blocked with octoate, poly(1,2-propyleneterephthalate-co-diethylene terephthalate) end blocked with an alkyl group of palmitate, stearyl, lauryl, palmitate, stearate, or laurate; and mixtures thereof.

42. A toner composition in accordance with claim 2 wherein S is an ion salt of a sulfonated difunctional monomer wherein the ion is an alkali or alkaline earth of lithium, sodium, potassium, cesium, rubidium, magnesium, barium, calcium or berylium, and the sulfonated difunctional moiety or monene is selected from the group consisting of dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenze, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfopentanediol, 2-sulfo-hexanediol, 3-sulfo-2-methylpentanediol, N,N-bis(2-hydroxyethyl)-2-aminoethane sulfonate, 2-sulfo-3,3-dimethylpentanediol, sulfo-p-hydroxybenzoic acid, and mixtures thereof.

43. A toner composition in accordance with claim 2 wherein the polyester resin possesses a number average molecular weight of from about 2,000 grams per mole to about 100,000 grams per mole, a weight average molecular weight of from about 4,000 grams per mole to about 250,000 grams per mole, and a polydispersity of from about 1.8 to about 17.

44. A toner composition in accordance with claim 2 with a triboelectric charge relative humidity sensitivity of from about 1.0 to about 2.8.

45. A toner composition with a triboelectric charge relative humidity sensitivity of from about 1 to about 2.5.

46. A toner composition in accordance with claim 1 wherein a charge enhancing additive is further included and is present in an amount of from about 0.05 to about 5 weight percent, and there results a positively or negatively charged toner.

47. A toner composition in accordance with claim 46 wherein the charge enhancing additive is incorporated into the toner, or is present on the surface of the toner composition, and there results a positively or negatively charged toner.

48. A toner composition in accordance with claim 2 further containing a wax component with a weight average molecular weight of from about 500 to about 20,000.

49. A toner composition in accordance with claim 48 wherein the wax component is selected from the group consisting of polyethylene and polypropylene.

50. A toner composition in accordance with claim 2 further containing as external additives metal salts of a fatty acid, colloidal silicas, metal oxides, or mixtures thereof.

51. A toner composition in accordance with claim 2 wherein the colorant is carbon black, cyan, magenta, yellow, red, blue, green, brown, or mixtures thereof.

52. A developer composition comprised of the toner composition of claim 1 and carrier particles.

53. A developer composition comprised of the toner composition of claim 2 and carrier particles.

54. A method of imaging which comprises formulating an electrostatic latent image on a negatively charged photoreceptor, affecting development thereof with the toner composition of claim 1, and thereafter transferring the developed image to a suitable substrate.

55. A toner composition in accordance with claim 2 further containing a charge enhancing additive of a quaternary ammonium compound.

56. A toner composition in accordance with claim 2 further containing a charge additive of hydroxy bis(3,5-ditertiary butyl salicylic) aluminate monohydrate, 3,5-ditertiary butyl salicylate, an aluminum compound of a hydroxy carboxylic acid, cetyl pyridinium halide, or distearyl dimethyl ammonium methyl sulfate, wherein the surface additives are comprised of metal salts of a fatty acid, colloidal silicas, metal oxides, or mixtures thereof, and wherein each surface additive is present in an amount of from about 0.1 to about 5 weight percent.

57. A toner in accordance with claim 1 wherein said moiety or group is present on the main chain of the polymer, or present as a pendant group.

58. A toner composition in accordance with claim 3 wherein said polyester is generated from at least one multifunctional branching monomer.

59. A toner comprised of a polyester resin containing at least one hydrophilic segment, hydrophobic segments, and colorant.

60. A toner in accordance with claim 59 further containing a wax.

61. A toner in accordance with claim 60 wherein said wax is polypropylene, polyethylene, or mixtures thereof.

62. A toner in accordance with claim 60 further containing a charge enhancing additive.

63. A toner in accordance with claim 59 further containing surface additives.

64. A toner in accordance with claim 63 wherein said surface additives are comprised of silica, metal oxides, metal salts of fatty acids, or mixtures thereof.

65. A toner in accordance with claim 64 wherein each of said additives is present in an amount of from about 0.5 to about 3 weight percent or parts.

66. A toner composition in accordance with claim 1 further containing wax, charge enhancing additive, and surface additives.

67. A developer comprised of carrier and the toner of claim 27.

68. A toner in accordance with claim 4 wherein R' represents said hydrophobic group; and S represents said hydrophilic group.

69. A toner in accordance with claim 1 wherein at least one is two for said hydrophobic end group.

70. A toner in accordance with claim 2 wherein at least one is from about 2 to about 10 for said hydrophilic moiety.

71. A toner in accordance with claim 2 wherein at least one for said hydrophobic is two.

72. A toner in accordance with claim 1 further containing surface additives.

73. A toner in accordance with claim 2 further containing surface additives.

74. A toner in accodance with claim 27 further containing wax and a charge enhancing additive.

* * * * *